United States Patent [19]

Ushida et al.

[11] Patent Number: 4,841,155

[45] Date of Patent: Jun. 20, 1989

[54] INDICATOR ARRANGEMENT FOR MOTOR VEHICLES

[75] Inventors: Masahiko Ushida; Hitoshi Shibata, both of Kariya, Japan

[73] Assignee: Nippondenso Co., Ltd., Kariya, Japan

[21] Appl. No.: 55,132

[22] Filed: May 28, 1987

[30] Foreign Application Priority Data

May 30, 1986 [JP] Japan ..... 61-126548

[51] Int. Cl.[4] ..... G09F 13/20

[52] U.S. Cl. ..... 250/463.1; 250/462.1; 40/543; 362/84

[58] Field of Search ..... 250/462.1, 463.1, 464.1, 250/465.1, 466.1, 467.1; 313/462; 362/23, 84; 40/543, 544, 615, 570

[56] References Cited

U.S. PATENT DOCUMENTS 2,480,584 11/1947 Kohlhauer et al. ..... 250/462.1
2,878,606 3/1959 Meijer ..... 40/576
4,536,656 8/1985 Sowa ..... 250/463.1
4,621,306 11/1986 Sell ..... 362/23
4,779,166 10/1988 Tanaka et al. ..... 362/84

*Primary Examiner*—Carolyn E. Fields
*Assistant Examiner*—John A. Miller
*Attorney, Agent, or Firm*—Cushman, Darby & Cushman

[57] ABSTRACT

Disclosed is an indication device of a gauging apparatus comprising an indicator panel having, on its surface, indication marks including patterns and characters, and a black light source for illuminating the surface of said indicator panel to excite a phosphor. Background portions of the indicator panel other than the indication marks are printed with a phosphor-containing paint which differs in color when it is exposed to light from the black light source from when it is exposed to ordinary light unable to excite the phosphor. The indication marks are printed with a white color paint which does not contain a phosphor and the phosphor-containing paint assumes a dark color when it is exposed to the ordinary light and assumes a bright color when it is exposed to light from the black light source.

5 Claims, 5 Drawing Sheets

INDICATOR ARRANGEMENT FOR MOTOR VEHICLES

BACKGROUND OF THE INVENTION

The present invention relates generally to an indicator arrangement for motor vehicles, and more particularly to an indicator for fluorescent display of information obtained in connection with a motor vehicle.

Various types of vehicle information indicators have been developed with a view to meeting demands of vehicle users in terms of visibility. One approach involves fluorescent display effected by applying to indicating portions such as patterns and characters a fluorescent material which radiates light with a specific color in response to illumination of light, such a technique being disclosed in U.S. Pat. No. 4,536,656 in which the indicating portions are printed with at least one phosphor-containing paint which differs in color when it is exposed to light capable of exciting the phosphor from when it is exposed to ordinary light unable to excite the phosphor. However, the prior technique does not produce satisfactory results because the indicating portions become foggy and out of focus due to expansion caused by light emission and therefore lose sharpness.

SUMMARY OF THE INVENTION

The present invention has been developed in order to remain the above-mentioned drawbacks inherent to the conventional fluorescent indicators.

It is therefore an object of the invention to provide an improved indicator device which capable of achieving clear display and improving the visibility.

In accordance with the present invention is provided an indication device of a gauging apparatus comprising an indicator panel having, on its surface, indication marks including patterns and characters, and a black light source for illuminating the surface of said indicator panel to excite a phosphor. Background portions of the indicator panel other than the indication marks are printed with a phosphor-containing paint which differs in color when it is exposed to light from the black light source from when it is exposed to ordinary light unable to excite the phosphor. The indication marks are printed with a white color paint which does not contain a phosphor and the phosphor-containing paint assumes a dark color when it is exposed to the ordinary light and assumes a bright color when it is exposed to light from the black light source.

Preferably, a pattern is further printed on the phosphor-containing paint applied on the background portions with a non-fluorescent paint.

BRIEF DESCRIPTION OF THE DRAWINGS

The object and features of the present invention will become more readily apparent from the following detailed description of the preferred embodiments taken in conjunction with the accompanying drawings in which.

DETAILED DESCRIPTION OF THE INVENTION

Figure 1:
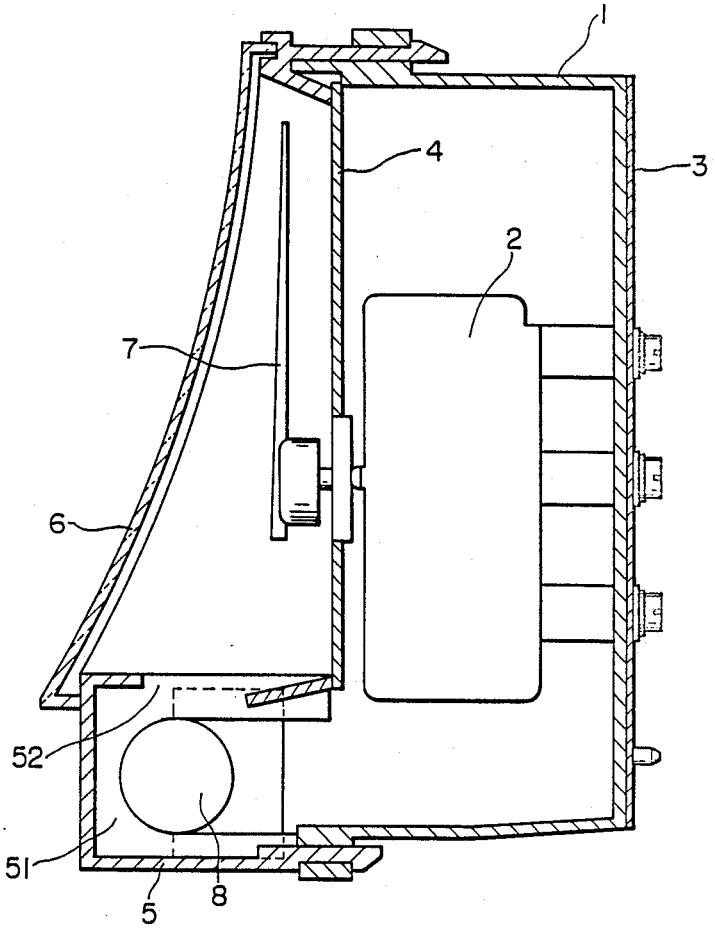
FIG. 1 is a side cross-sectional view of an indicator device according to an embodiment of the present invention incorporated into a gauging device for use in a motor vehicle.

Referring now to FIG. 1, there is illustrated a gauging device, or a meter, including an indicator device according to an embodiment of the present invention. In FIG. 1, the gauging device is shown as comprising a gauge 2 such as speed meter A, tachometer B, clock C, fuel gauge D, ammeter E and engine temperature gauge F (FIGS. 2 and 3) which are encased in a case 1. The gauge 2 is connected to a printed circuit board 3 provided on the rear surface of the case 1 which is in turn coupled to external devices such as power supply. A dial board 4, or indicator panel, is placed in front of the gauge 2 and further a pointer 7 coupled to the gauge 2 is placed in front of the indicator panel 4. Also included in the gauging device are a window glass 6 and a plate 5 for defining a light chamber 51 positioned at the lower portion of the gauging device and extending in the longitudinal direction of the case 1 for encasing a pipe-like black light source 8 such as ultraviolet lamp. The light chamber 51 has a window 52 so that black light illuminates the indicator panel 4 therethrough. A power source for the ultraviolet lamp 8 may be placed in or out of the case 1.

Figure 2:
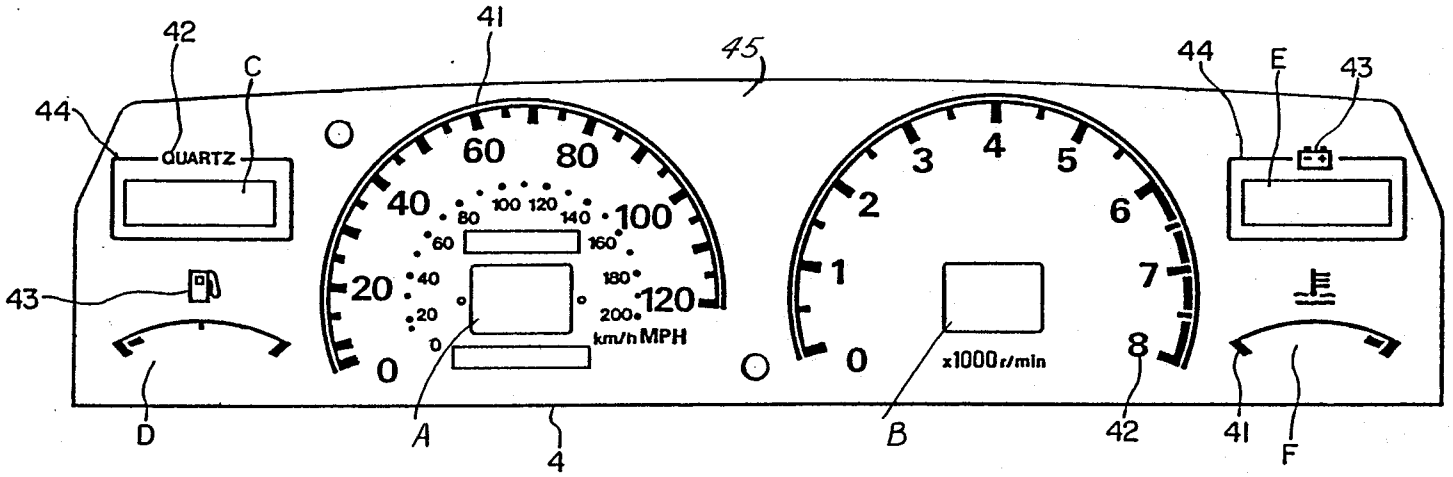
FIG. 2 is an illustration of an indicator panel of the indicator device when it is exposed to the ordinary light obtained from the outside of a motor vehicle.
Figure 3:
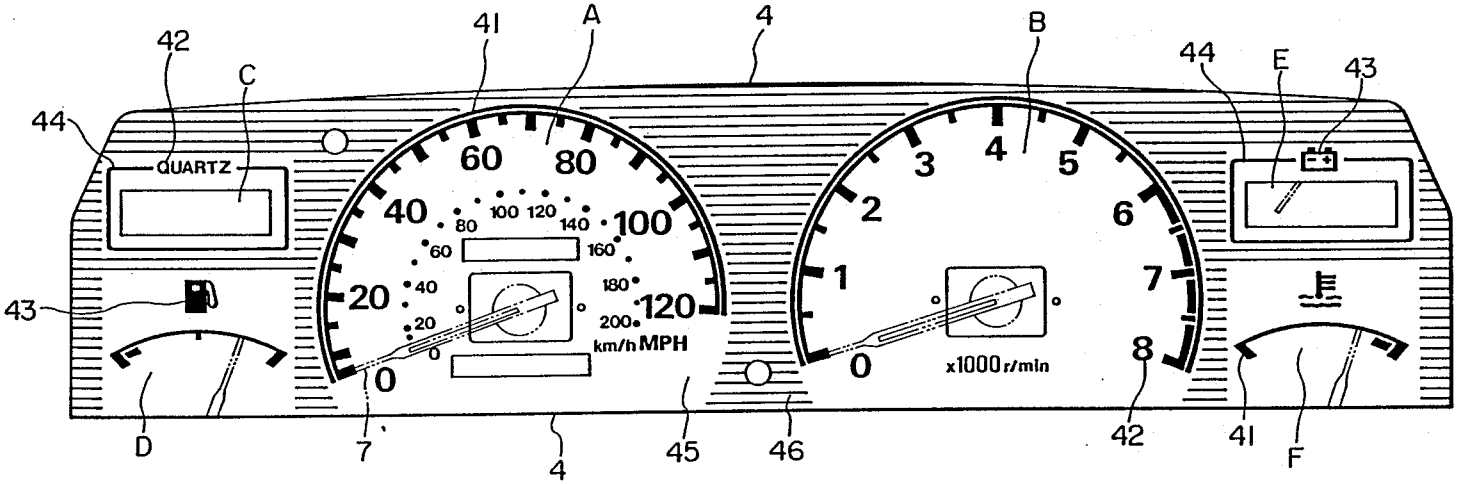
FIG. 3 is an illustration of the indicator panel when it is exposed to light from a black light source.

As shown in FIGS. 2 and 3, on the indicator panel 4 made of resin are formed various types of indicating marks, i.e., indicating portions, such as graduations 41, numerals or characters 42, patterns 43 and division lines 44, which are printed with a white paint which does not containing a phosphor. The portions 45 (background portions) other than the indicating marks on the indicator panel 4 are printed with a fluorescent paint which contains at least one phosphor so that its color is dark gray when exposed to ordinary light obtained in the daytime and, on the other hand, is bright brown when exposed to light (ultraviolet light, for example) capable of exciting the phosphor. For example, the fluorescent paint contains ZnS:Sn.

Figure 4:
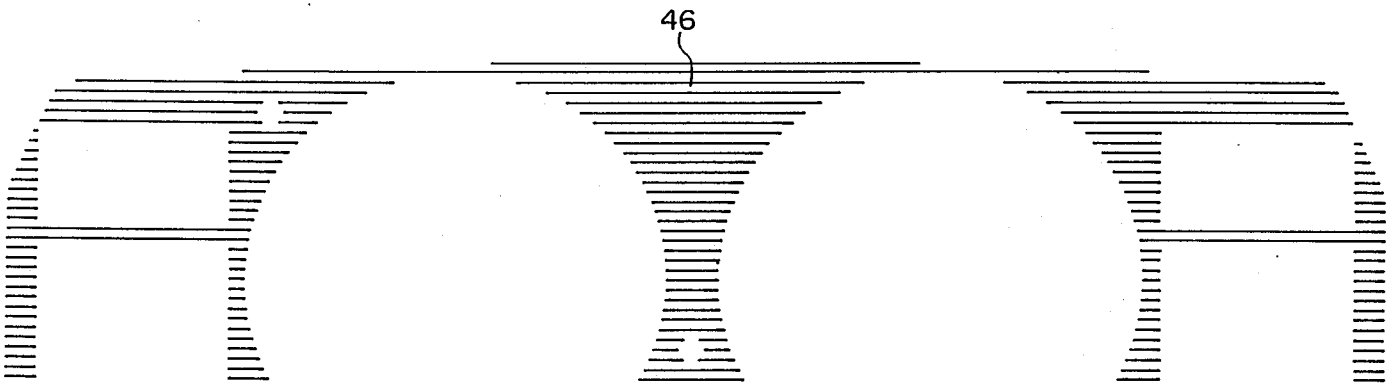
FIG. 4 shows one example of patterns printed on background portions of the indicator panel other than indicating portions.

In addition, on the fluorescent paint applied on the background portions 45 is further formed a pattern 46 (FIG. 4) printed with a non-fluorescent paint which is substantially the same color as the fluorescent paint when exposed to the ordinary light unable to excite the phosphor.

Figure 5B:
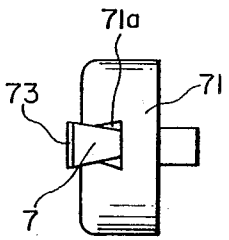
FIGS. 5A and 5B show a structure of a pointer of the indicator device.
Figure 5A:
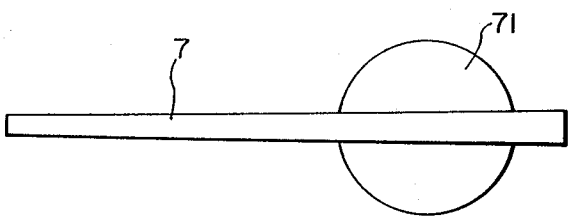

The pointer 7, as shown in FIGS. 5A and 5B, is fitted in a tapered groove 71a of a disc-like base 71 and on the surface of the pointer 7 is printed another fluorescent paint 73, containing $Y_2O_3$:Eu, which is white in color when exposed to the ordinary light and is red in color due to exciting when exposed to ultraviolet light.

According to the above-mentioned arrangement, when the ultraviolet lamp 8 is not turned on, i.e., in the daytime in which the indicator panel 4 is illuminated with the ordinary light obtained from outside of the motor vehicle, the indicating marks 41 to 44 are white in color and the portions 45 other than the indicating marks are dark gray. Therefore, the indicating marks 41 to 44 are contrasted with the dark gray portions as shown in FIG. 2, resulting in excellent visibility of the indicating marks 41 to 44.

On the other hand, when the ordinary light is not enought to illuminate the indicator panel 4, i.e., at night, the ultraviolet lamp 8 is turned on. In response to illumination of ultraviolet light to the indicator panel 4, the portions 45 entirely emits light with bright brown and therefore the indicating marks 41 to 44 become dark due to silhouette effect. This also results in excellent visibility of the indicating marks 41 to 44. In addition, the pointer 7 emits light with red due to exciting and the pattern 46 appears in the background portions 45, improving display effect.

Figure 6A:
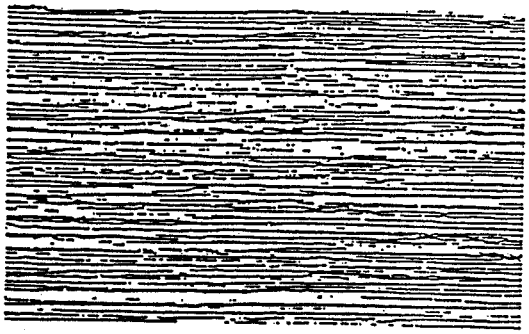
FIGS. 6A to 6C are illustrations of other patterns to be printed on the background portions.
Figure 6B:
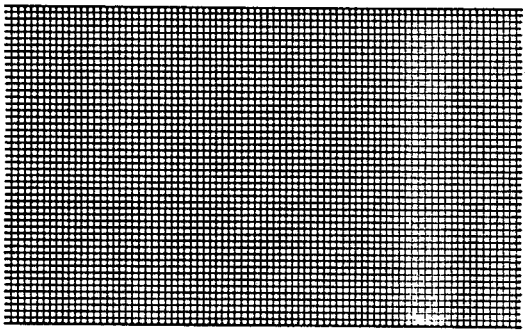
Figure 6C:
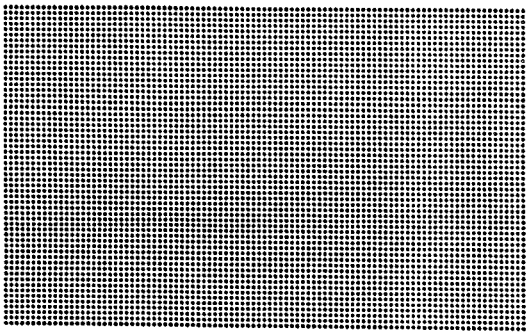

It should be understood that the foregoing relates to only preferred embodiments of the present invention, and that it is intended to cover all changes and modifications of the embodiments of the invention herein used for the disclosures, which do not constitute departures from the spirit and scope of the invention. For example, the pattern 46 formed on the background portions 45 can be determined to meet the demands of users. FIGS. 6A through 6C shows other patterns. Furthermore, it is possible to freely determine the combination of the color of the indicating marks and the color of the background portions.

What is claimed is:

1. An indication device of a gauging apparatus, comprising:

an indication panel having with a background portion and indication marks including patterns and characters; and a black light source for illuminating the surface of said indicator panel, said black light source being capable of exciting a fluorescent material, said black light source being positioned so as to direclty illuminate the surface of said panel, wherein said background portion of said indicator panel surface is printed with a fluorescent-material-containing paint which has a first color when exposed to light from said black light source and a second color when exposed to ordinary light unable to excite the fluorescent material.

2. An indication device as claimed in claim 1, wherein said indication marks are printed with a white color paint which does not contain a fluorescent material and said first color of said fluorescent-material-containing paint is a bright color and said second color is a dark color.

3. An indication device as claimed in claim 1, wherein a pattern is printed on said background portions with a paint which does not contain a fluorescent material and which is substantially coincident in color with said second color of said fluorescent-material-containing paint.

4. An indication device of a gauging apparatus, comprising:

an indicator panel having a surface with a background portion and indication marks including patterns and characters;

a pointer provided in connection with at least one of said indication marks; and a black light source for illuminating the surface of said indicator panel and said pointer said black light source being capable of exciting fluorescent material, said black light source being positioned so as to directly illuminate the surface of said panel, wherein said background portion of said indicator panel surface is printed with a first fluorescent-material-containing paint which has a first color when it is exposed to light from said black light source and a second color when it is exposed to ordinary light unable to excite the fluorescent material, and wherein said pointer is printed with a second fluorescent-material-containing paint which assumes a color different from said first color of said background portion when exposed to light from said black light source.

5. An indication device as claimed in claim 4, wherein a pattern is further printed on said background portion with a paint which does not contain a fluorescent material and which is substantially coincident in color with said second color of said fluorescent-material-containing paint of said background portion when exposed to the ordinary light.

* * * * *